US007765942B2

(12) United States Patent
Choi

(10) Patent No.: US 7,765,942 B2
(45) Date of Patent: Aug. 3, 2010

(54) INTERLOCKING COMPONENT ASSEMBLY FOR AN EXPANDABLE RACK ASSEMBLY

(76) Inventor: Ying-Kit Choi, Room 706, No. 303, Tun-Hwa North Road, Taipei Hsien (TW)

( * ) Notice: Subject to any disclaimer, the term of this patent is extended or adjusted under 35 U.S.C. 154(b) by 271 days.

(21) Appl. No.: 11/944,057

(22) Filed: Nov. 21, 2007

(65) Prior Publication Data

US 2009/0057255 A1 Mar. 5, 2009

(30) Foreign Application Priority Data

Aug. 28, 2007 (TW) ..... 96131770 A

(51) Int. Cl.
*A47B 47/00* (2006.01)

(52) U.S. Cl. ..... 108/193; 108/147.16

(58) Field of Classification Search ..... 211/134, 211/169, 175, 186, 187, 188, 189, 190, 194, 211/207, 208; 108/60, 147.11–147.13, 147.17, 108/147.18, 180, 184, 186, 190, 193, 147.16; 312/257.1, 107, 108, 111, 205, 263, 265.5
See application file for complete search history.

(56) References Cited

U.S. PATENT DOCUMENTS 472,347 A * 4/1892 Gibbs ..... 211/187
923,721 A * 6/1909 Smith ..... 108/92
1,401,057 A * 12/1921 Elliott ..... 108/101
1,431,823 A * 10/1922 Leconte ..... 108/190
1,631,718 A * 6/1927 Campbell ..... 312/140
3,141,423 A * 7/1964 Christensen ..... 108/190
3,272,582 A * 9/1966 Mack et al. ..... 312/265.4
3,307,505 A * 3/1967 Windross ..... 108/180
3,636,893 A * 1/1972 Lange ..... 108/190
3,684,285 A * 8/1972 Kane ..... 273/241
3,783,801 A * 1/1974 Engman ..... 108/60
3,831,533 A * 8/1974 Kellogg ..... 108/64
3,879,096 A * 4/1975 Blodee ..... 312/265
4,034,682 A * 7/1977 Bizinover et al. ..... 108/107
4,099,472 A * 7/1978 Kellogg ..... 108/185
4,145,098 A * 3/1979 Alexander ..... 312/195
4,318,576 A * 3/1982 Ford ..... 312/264
4,418,627 A * 12/1983 Baker ..... 108/91

(Continued)

FOREIGN PATENT DOCUMENTS

DE 4301290 A1 * 7/1994

(Continued)

*Primary Examiner*—Michael Safavi
*Assistant Examiner*—Joshua Rodden
(74) *Attorney, Agent, or Firm*—Shoemaker and Mattare

(57) ABSTRACT

An interlocking component assembly of an expandable rack assembly is proposed, including a plurality of horizontally-deposed panels each formed with a first opening, a plurality of vertically-deposed panels each disposed between two horizontally-deposed panels, a plurality of middle joint components each disposed in vertically-deposed panels, and a plurality of interlocking components each adapted for interconnecting two middle joint components to interconnect and fasten the horizontally-deposed panel to the vertically-deposed panel, wherein the height of the vertically-deposed panel is greater than the length of the middle joint component, such that the vertically-deposed panel can be coupled to the interlocking component to securely engage the horizontally-deposed panel with the vertically-deposed panel, thereby enabling the rack assembly to be free from limitations of assembling locations or dimensional specifications while the structural rigidity and strength of the assembled rack unit is enhanced.

9 Claims, 12 Drawing Sheets

U.S. PATENT DOCUMENTS 4,474,416 A * 10/1984 Rogahn ..... 312/265.2
4,673,092 A * 6/1987 Lamson et al. ..... 211/188
4,786,122 A * 11/1988 Nichoalds ..... 312/257.1
4,876,835 A * 10/1989 Kelley et al. ..... 52/239
4,884,420 A * 12/1989 Finkel et al. ..... 70/58
5,525,005 A * 6/1996 Chen ..... 403/374.4
5,584,398 A * 12/1996 Lin ..... 211/40
5,664,757 A * 9/1997 Simonis ..... 248/672
5,706,741 A * 1/1998 Thorp et al. ..... 108/193
5,746,139 A * 5/1998 Villanueva ..... 108/92
5,810,505 A * 9/1998 Henriott et al. ..... 403/230
5,881,653 A * 3/1999 Pfister ..... 108/147.13
5,964,360 A * 10/1999 Hwang ..... 211/186
5,971,174 A * 10/1999 Strock ..... 211/186
6,123,035 A * 9/2000 Pfister ..... 108/180
6,166,910 A * 12/2000 Ronberg et al. ..... 361/724
6,247,414 B1 * 6/2001 Sikora et al. ..... 108/190
6,493,995 B2 * 12/2002 McKenzie ..... 52/36.4
6,764,144 B2 * 7/2004 Insalaco et al. ..... 312/108
6,922,896 B2 * 8/2005 Choi ..... 29/897.15
6,981,751 B2 * 1/2006 Powell ..... 312/265.3
7,384,264 B2 * 6/2008 Ego et al. ..... 432/261
7,386,960 B2 * 6/2008 Molteni ..... 52/238.1
7,467,721 B2 * 12/2008 Choi ..... 211/189
2007/0125735 A1 * 6/2007 Choi ..... 211/186
2008/0156759 A1 * 7/2008 Lai ..... 211/187

FOREIGN PATENT DOCUMENTS

EP 149482 A2 * 7/1985
FR 2634991 A3 * 2/1990

* cited by examiner

INTERLOCKING COMPONENT ASSEMBLY FOR AN EXPANDABLE RACK ASSEMBLY

BACKGROUND OF THE INVENTION

1. Field of the Invention

The present invention generally relates to interlocking component assemblies and, more particular, to an interlocking component assembly of an expandable rack assembly to hold a variety of objects for display or storage purposes, in a manner to preserve the integrity of each object.

2. Description of Prior Art

Do it yourself, often referred to by the acronym DIY, that focus on people creating things for themselves without the aid of paid professionals, is a common trend in modern societies. As such, Ready-to-assemble furniture, also known as "knock-down furniture" or "flat packs", is furniture supplied as a kit of flat parts and fasteners to be assembled, usually by the end user, with simple tools, become very common and popular. Assembled furniture is bulky, and incurs storage and delivery costs disproportionate to its production costs; packaged RTA furniture occupies little more volume than that of its components, and can be shipped at far lower cost. Factory assembly is not necessary, further reducing cost. RTA furniture is typically packaged in a compact carton with detailed assembly instructions for easy assembly.

Among the RTA furniture, rack assembly structures for holding or storing things are most often seen and applied by consumers. Conventional rack assemblies typically consist of a plurality of panels for forming one or more frame units with intersecting fasteners disposed on the rear of the frame unit to strengthen structural integrity of each of the panels or frame units mounted thereto.

However, conventional fasteners often lack sufficient rigidity to effectively support and hold the assembled rack structure in secured position, which in turn makes the rack assembly structure unable to sustain and hold objects with heavy weight. Further, the panels or frame unit that constitute a rack assembly are manufactured by standardization according to specifications, thus lacking flexibility in applications if the user desires to add more frame units for expanding the assembled rack structure. As such, the conventional rack assembly structures are known to have disadvantages of insufficient structural rigidity and inconvenient application.

In an attempt to overcome the aforementioned drawbacks of prior techniques, Taiwanese Patent Publication has disclosed an interlocking component assembly for a rack assembly, as depicted in FIG. 1A to FIG. 1C. The interlocking component assembly is comprised of a plurality of horizontally-deposed panels 1, 1*a*, a plurality of vertically-deposed panel 3 each to be mounted between two horizontally-deposed panels 1, 1*a*, a plurality of expandable members 2 each to be disposed on the top of vertically-deposed panels 3 and between horizontally-deposed panels 1, 1*a*, and a plurality of interlocking components 4 adapted to securely fasten and hold horizontally-deposed panels 1, 1*a*, vertically-deposed panel 3 and expandable members 2 in position.

As illustrated in FIGS. 1A and 1B, each of two end of horizontally-deposed panels 1, 1*a* has a first opening 10 formed therethrough and a protruding footstool, respectively disposed at each of two opposing sides on the bottom of the horizontally-deposed panel 1.

The vertically-deposed panel 3 is a hollow structure in a frame shape and formed with a second opening 30 flush with the first opening 10, wherein a first positioning portion 300 is disposed at two opposed inner walls of the second opening 300 respectively. The expandable member 2 is disposed to straddle across two ends of the vertically-deposed panel 3 and to posit between an end portion of the vertically-deposed panel 3 and horizontally-deposed panels 1, 1*a*, the expandable member 2 being formed with a third opening 20, wherein a third positioning portion is disposed at each of the two opposed inner walls of the third opening 20 respectively.

FIG. 1C illustrates the interconnection and penetration of the interlocking member 4 into the horizontally-deposed panel 1*a*, the vertically-deposed panel 3 and the expandable member 2. The interlocking member 4 is a cylindrical structure having a plurality of second positioning portions 40 disposed on the circumferential wall thereof, the interlocking member 4 being adapted to penetrate through the first opening 10, the third opening 20, the second opening 30 in sequential order. The second positioning portion 40 is disposed to abut against the first positioning portion 300 and the third positioning portion 200, thereby preventing the interlocking member 4 from moving arbitrarily in the expandable member 2 and the vertically-deposed panel 3. A plurality of screws 42 each are penetrated through a respective washer and locked into a corresponding screw bore 41 respectively, such that horizontally-deposed panels 1, 1*a*, vertically-deposed panel 3 and expandable members 2 can be securely fastened and held in position by the penetration of the interlocking member 4 to form at least one or more frame units.

In the illustrated frame structure described above, the front and rear sides of the assembled frame unit may further include a mobile door and a back panel (not shown). When the user desires to expand and increase the number of the frame units, it requires only having a required number of horizontally-deposed panels 1, expandable members 2, and vertically-deposed panels 3 stacked on one another on the assembled frame unit, and further an extended interlocking member 4 penetrating therethrough for securely interconnecting and holding each of horizontally-deposed panels 1, 1*a*, vertically-deposed panel 3, and expandable members 2 by screws on each of the two sides thereof. Because the frame unit is often posited at a corner location where assembly is to be completed, it is cumbersome and inconvenient to have an extended interlocking member 4 easily assembled under the awkward situation.

Consequently, there is a need for an improved rack assembly that can overcome the defects of the prior art while providing ease in assembly and installation for users' convenience.

SUMMARY OF THE INVENTION

In light of the drawback associated with the conventional techniques as described above, the primary object of the present invention is to provide an interlocking component assembly for an expandable rack assembly that can be assembled easily.

Another object of the present invention is to provide an interlocking component assembly for an expandable rack assembly that is adjustable to meet the users' need.

In accordance with the foregoing and other objectives, the present invention provides an interlocking component assembly of an expandable rack assembly, the interlocking component assembly comprising: a plurality of horizontally-deposed panels each formed with a first opening, wherein a protective sheath may be adapted to cover the first opening, and the horizontally-deposed panel is a panel body made of one selected from the group of materials consisting of glass, stone, cement, metal and wood; a plurality of vertically-deposed walls of the second opening respectively, and wherein a buffering member can be disposed at each of two ends of the vertically-deposed panel at a position in contact with horizontally-deposed panels, and wherein an embedding portion adapted to hold the buffering member may be disposed at each of two opposed ends of the vertically-deposed panel at a position close to the second opening; a plurality of middle joint components each penetrating through the second opening of the vertically-deposed panel and fastened by the first positioning portion, wherein the length of the middle joint component may be smaller than the height of the vertically-deposed panel, and wherein a first coupling portion, which may be but is not limited to a screw bore, may be disposed at each of two ends thereof, and a plurality of interlocking components each penetrating through the first opening of the horizontally-deposed panels and having a second coupling portion corresponding to the first coupling portion disposed at each of the two ends thereof for coupling a pair of middle joint components together and thus interconnecting horizontally-deposed panels with the vertically-deposed panel.

In addition, the present invention further provides an interlocking component assembly for an expandable rack assembly, the interlocking component assembly comprising: a plurality of horizontally-deposed panels each formed with a first opening and an assist first opening adjacent to one another; a plurality of vertically-deposed panels each disposed between two horizontally-deposed panels and formed with a second opening flush with the first opening and the assist first opening, wherein a first positioning portion is disposed on each of two opposed inner walls of the second opening; a plurality of middle joint components penetrating through the second opening of the vertically-deposed panel and fastened by the first positioning portion, wherein a first coupling portion is disposed at each of two ends of the middle joint component, and wherein the length of the middle joint component is smaller than the height of the vertically-deposed panel; a plurality of sub-vertically-deposed panels each disposed between two horizontally-deposed panels and formed with a second opening flush with the first opening and the assist first opening, wherein a first positioning portion is disposed on each of two opposed inner walls of the second opening respectively; a plurality of sandwiched panels disposed between two sub-vertically-deposed panels and formed with a through bore and an assist through bore flush with the first opening and the first assist opening; a plurality of sub-middle joint components each penetrating through the second opening of the sub-vertically-deposed panel and fastened by the first positioning portion, wherein a first coupling portion is disposed at each of two opposed inner walls of the sub-middle joint component respectively; and a plurality of interlocking components penetrating through the first opening and the first assist opening of the horizontally-deposed panel and having a first and a second coupling portions each disposed at two ends thereof, respectively, thereby fastening a pair of middle joint components together to interconnect horizontally-deposed panels with the vertically-deposed panels for connecting the sub-middle joint components to thus interconnect and fasten the horizontally-deposed panel, the sandwiched panels and the sub-vertically-deposed panel.

In one preferred embodiment, the second opening may comprise a plurality of round apertures interconnecting with one other, and the middle joint component may be a cylindrical body positioned in the interconnected round aperture, wherein the outer diameter of the middle joint component is larger than that of the first opening. Further, a second positioning portion, which may be but is not limited to a groove, may be disposed at an outer peripheral wall of the middle joint component for correspondingly coupling with the first positioning portion which may be but is not limited to a protruding rib.

In another preferred embodiment, the second opening may comprise a plurality of rectangular apertures interconnecting with one other, and the middle joint component may be a rectangular pillar positioned in the rectangular aperture.

In yet another embodiment, an assist vertically-deposed panel may be disposed in the second opening for allowing the middle joint component to penetrate therethrough, wherein the assist vertically-deposed panel may be formed with a third opening for receiving the middle joint component therein; wherein a fourth positioning portion, which may be but is not limited to a groove, may be disposed on each of two opposed ends of the assist vertically-deposed panel, to couple with the first positioning portion which may be but is not limited to a protruding rib, a third positioning portion may be disposed on each of two opposed inner walls of the third opening, and wherein a second positioning portion, which may be but is not limited to a protruding rib, may be disposed on the outer peripheral wall of the middle joint component, to couple with the third positioning portion which may be but is not limited to a groove.

In yet further embodiment, the structure of the sub-vertically-deposed panel is an equivalent of the vertically-deposed panel, the height of the sub-vertically-deposed panel being smaller than that of the vertically-deposed panel; wherein the structure of the sub-middle joint component is an equivalent of the sub-middle joint component, the length of the sub-middle joint component being shorter than that of the middle joint component; wherein an embedding portion is disposed on each of two opposed ends of the sub-vertically-deposed panel at a position adjacent to the second opening, wherein a buffering member is provided on the embedding portion at a position in contact with the horizontally-deposed panel; wherein a plurality of interconnected apertures in either round or rectangular shape are defined in the second opening of the sub-vertically deposed panel, and the sub-middle joint component may be a cylindrical or rectangular body to be positioned in the opening of the sub-vertically-deposed panel; and wherein the first positioning portion of the sub-vertically-deposed panel, which may be but is not limited to a protruding rib; and a second positioning portion, which may be but is not limited to a groove, may be disposed on the outer peripheral wall of the sub-middle joint component for correspondingly coupling with the embodied protruding rib of the first positioning portion.

In accordance with the design of the interlocking component assembly described above, the length of the sub-middle joint component is smaller than the height of the vertically-deposed panel, such that the one or more frame units constituted by the plurality of horizontally-deposed panels and vertically-deposed panels may be securely engaged with and fastened to one another by the penetration and interconnection of the middle joint component and the interlocking component. Further, the length variations between the assembly components provides excellent flexibility and great convenience in assembly to be free of installation limitations, such as the length of the middle joint component and the assembling location, while being able to enhance structural rigidity and strength of the frame unit.

In addition, the coordination between the horizontally-deposed panel with the vertically-deposed panel permits the vertically-deposed panel to be flexibly adjusted in a horizontal or vertical orientation with respect to the horizontally-deposed panel, thereby providing varieties in assembly for optimal effects and combinations of expandable rack assemblies. Moreover, the foregoing structure allows an added vertically-deposed panel to be extended towards the direction of the other vertically-deposed panel to function as a rear wall structure, the sandwiched panel to be utilized for storage purposes, and also the two horizontally-deposed panels to be divided into a plurality of spaces for whatever purposes a user may have in mind.

These and other advantages, purposes and objects will be more apparent from a review of the drawings and the description which follows.

DETAILED DESCRIPTION OF THE PREFERRED EMBODIMENTS

First Preferred Embodiment

Figure 1A:
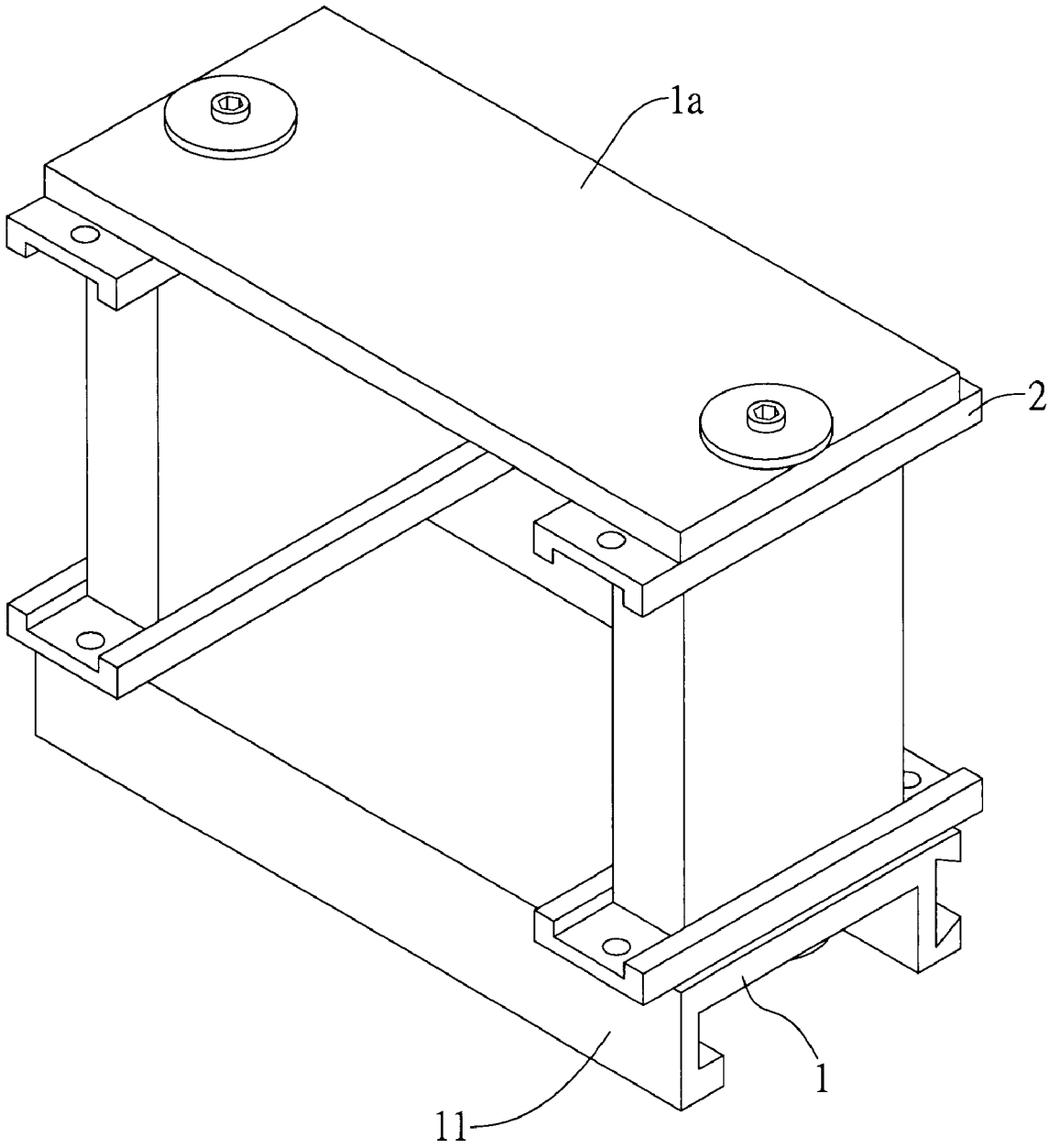
FIG. 1A (PRIOR ART)
FIGS. 1A to 1C (PRIOR ART) each are perspective views showing a conventional interlocking component assembly of an expandable rack assembly disclosed in Taiwanese Patent Gazette No. 12822265.
Figure 1B:
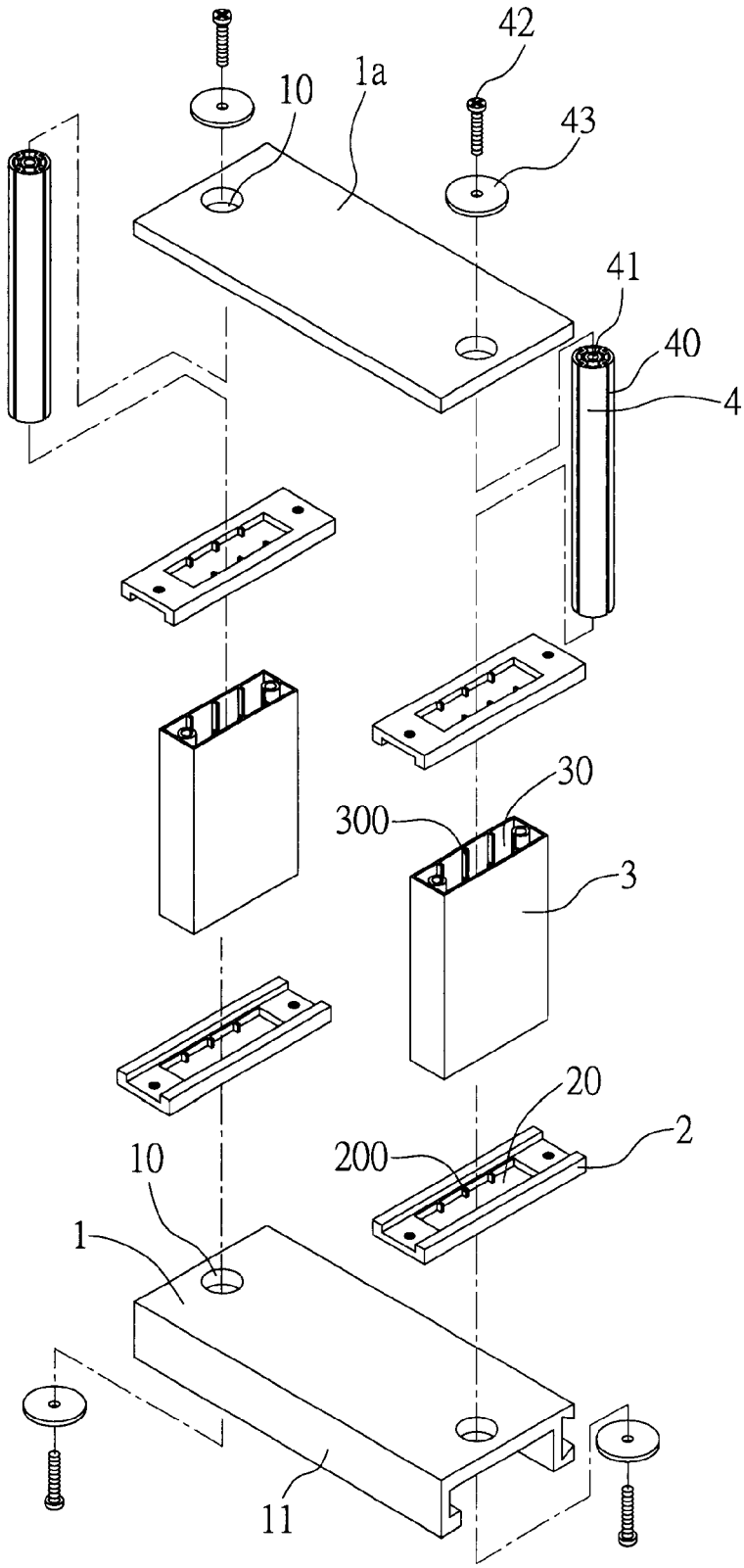
FIG. 1B (PRIOR ART)
Figure 1C:
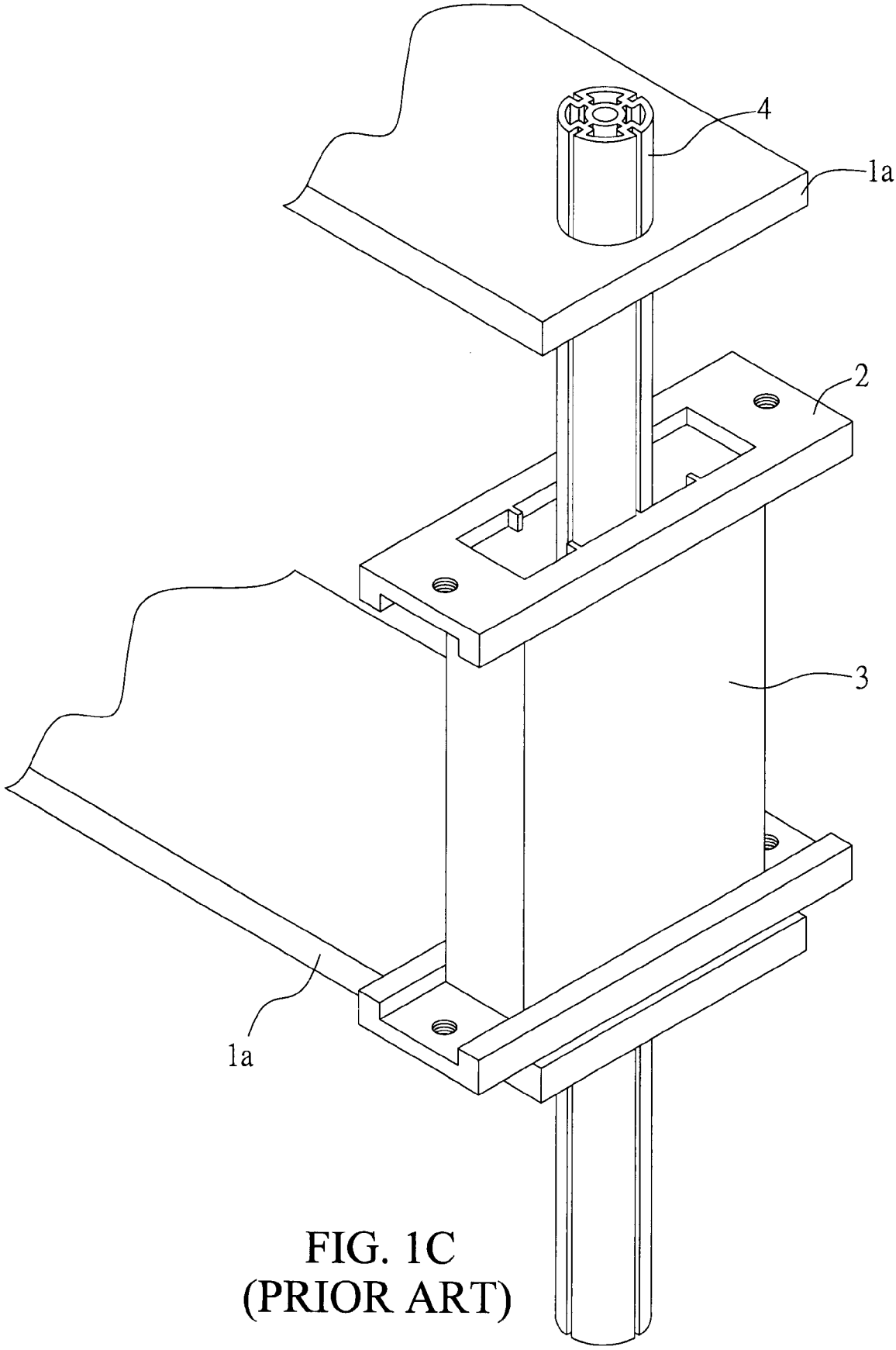
FIG. 1C (PRIOR ART)
Figure 2A:
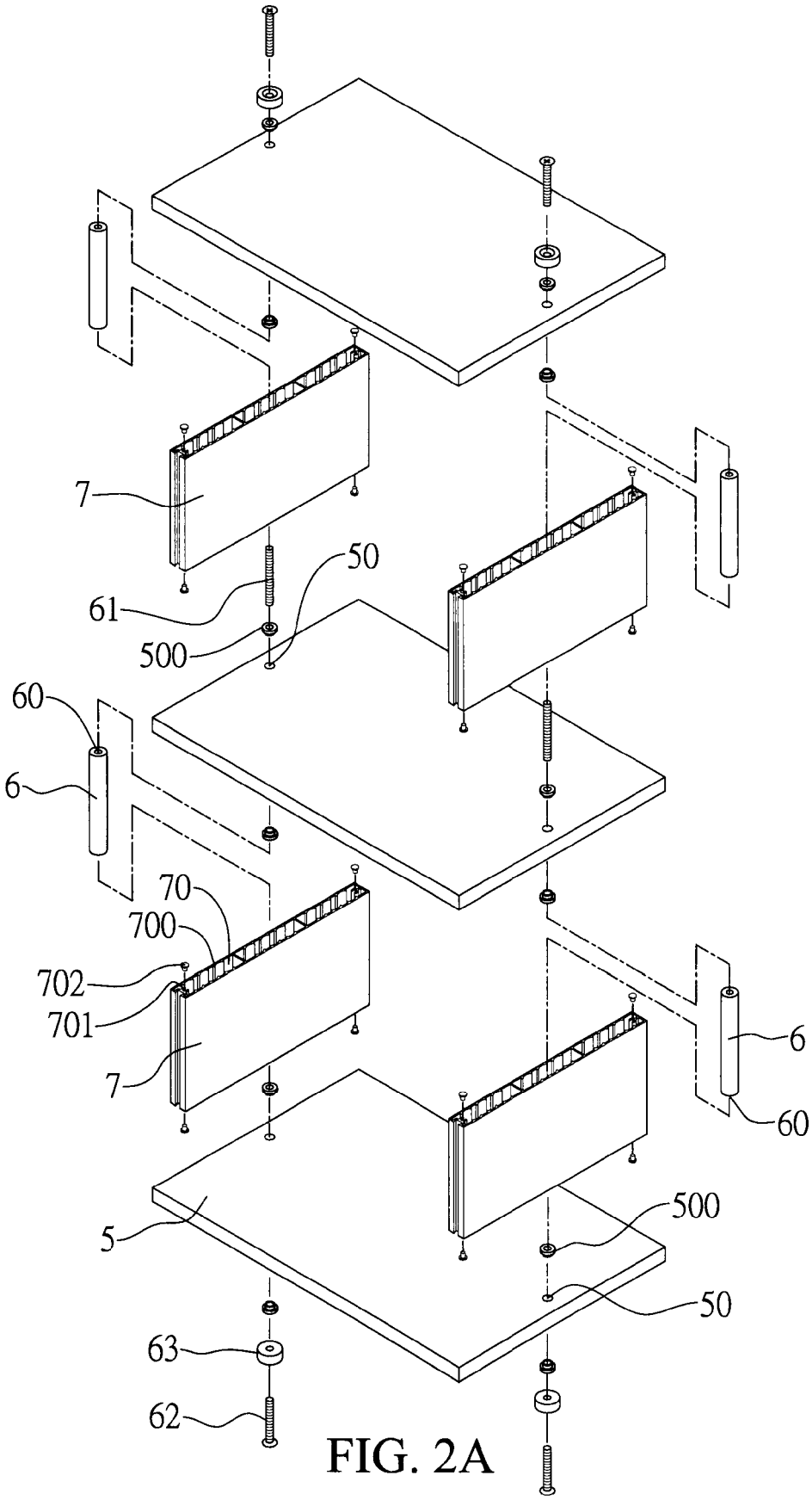
FIGS. 2A to 2C each are perspective views each showing a first embodiment of an interlocking component assembly of an expandable rack assembly according to the present invention.
Figure 2B:
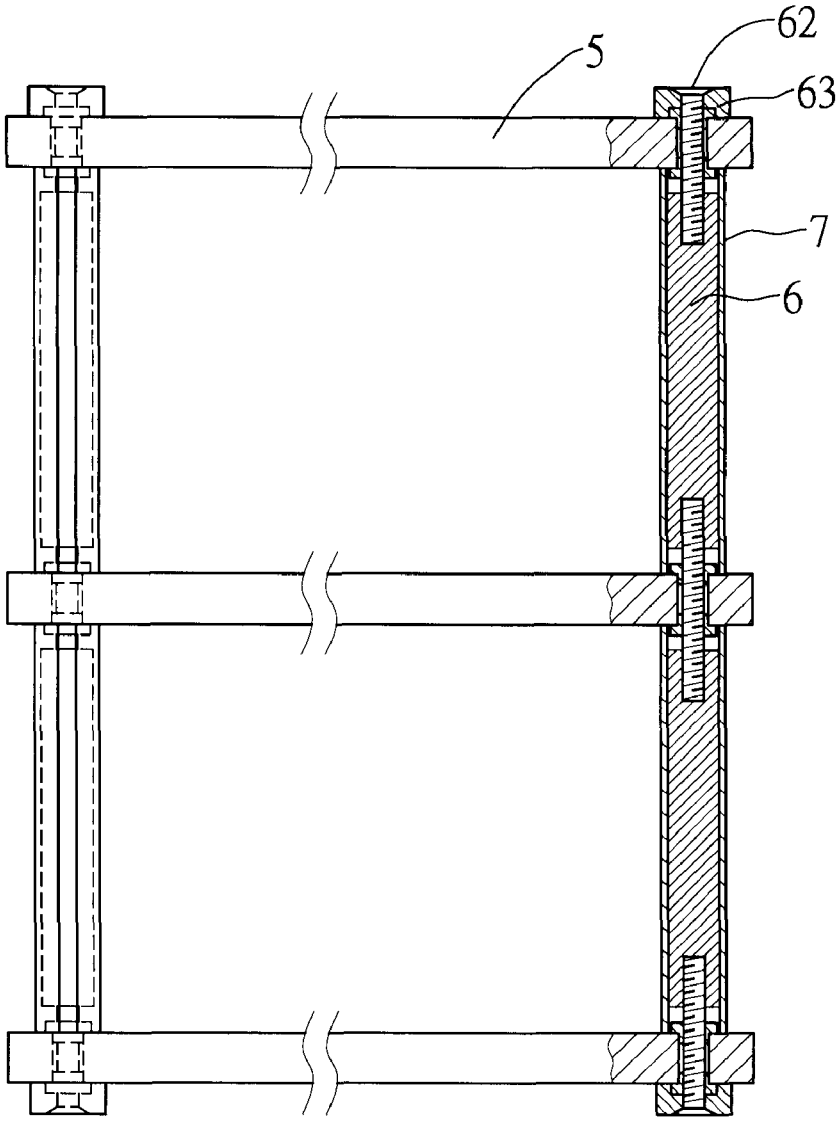
Figure 2C:
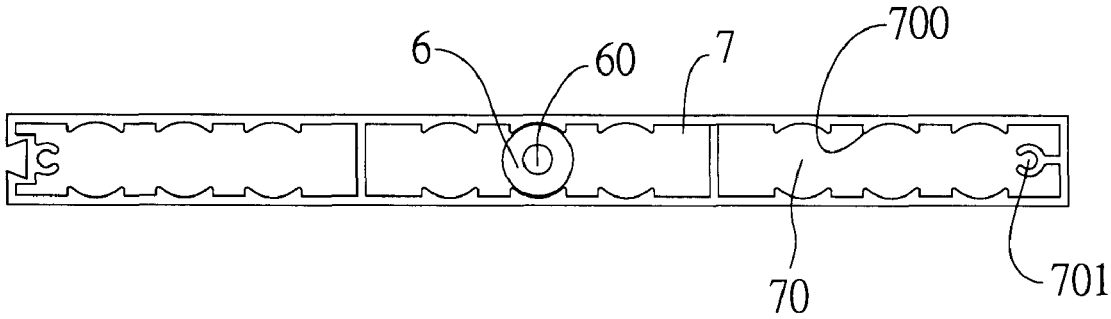

FIGS. 2A to 2C illustrate the first embodiment of an interlocking component assembly of an expandable rack assembly in accordance with the present invention. As shown, the interlocking component assembly of an expandable rack assembly of the present invention includes a plurality of horizontally-deposed panels 5; a plurality of vertically-deposed panel 7 each disposed between two horizontally-deposed panels 5; a plurality of middle joint components 6 each disposed in the vertically-deposed panel 7; and a plurality of interlocking components 61 each disposed to penetrate through and interconnect the horizontally-deposed panel 5 with the vertically-deposed panel 7.

Each of horizontally-deposed panel 5 is formed with a first opening 50 and may include a protective sheath 500 covered thereon for protecting the peripheral surface corresponding to the first opening 50, wherein the horizontally-deposed panel 5 may be made of one selected from the group of materials consisting of glass, stone, cement, metal and wood.

Referring to FIG. 2C, each of vertically-deposed panels 7 is a hollow and frame-shape structure to be disposed between two horizontally-deposed panels 5 and is formed with a second opening 70 that is flush with the first opening 50 of the horizontally-deposed panel 5, wherein a first positioning portion 700 is disposed at a position on each of two opposed inner walls of the second opening 70 respectively to form a plurality of interconnected round apertures, and wherein a buffering member 702 may be disposed on an end surface of the vertically-deposed panel 7 at a position in contact with horizontally-deposed panels 5 to increase friction therebetween, and wherein an embedding portion 701 adapted to hold the buffering member 702 may be disposed on each of two opposite ends of the vertically-deposed panel 7 at a position close to the second opening 70.

The middle joint component 6 is a cylindrical body having a length smaller than the height of the vertically-deposed panel 7 so as to be disposed in the second opening 70 of the vertically-deposed panel 7, wherein the outer diameter of the middle joint component 6 is slightly smaller that that of the round interconnected aperture of the second opening 70, such that the first positioning portion 700 enables the middle joint component 6 to be fastened in the round aperture, wherein the outer diameter of the middle joint component 6 is larger than that of the first opening 50 of horizontally-deposed panel 5, and a first coupling portion 60, which may be but is not limited to a screw bore, may be disposed at each of two ends of the middle joint component 6 respectively.

Each of the interlocking component 61 is disposed to penetrate through the first opening 50 of the horizontally-deposed panels 5 and having a second coupling portion corresponding to the first coupling portion 60 respectively disposed at each of two ends thereof, thereby allowing two middle joint components 6 to be inconnected with one another and thus interconnecting horizontally-deposed panel 5 with the vertically-deposed panel 7. In this embodiment, the interlocking components 61 may be but is not limited to a screw. In other aspects, the interlocking components 61 may be but is not limited to a rod body such as a screw comprising a second coupling portion disposed at each of two ends thereof.

In assembling the interlocking component assembly of a rack assembly, the vertically-deposed panels 7 are first assembled with and on horizontally-deposed panels 5, each of middle joint component 6 is inserted in the second opening 70, and then each of the plurality of screws with its corresponding washer is locked into the first opening 50 to be fastened an locked in the first coupling portion 60. In that the length of the middle joint component 6 is smaller than the height of the vertically-deposed panel 7, the provision of the protective sheath thereof prevents an end portion of the middle joint component 6 from getting horizontally-deposed panels 5 worn and damaged, and the interlocking components 61 is used to connect with other middle joint component 6. Each of interlocking component 61 is penetrated into the first opening 50 and then coupled with the first coupling portion 60 of the other first coupling portion 60, thereby allowing the two first coupling portions 60 to be interconnected with one another in a string manner. Each of vertically-deposed panels 7 and horizontally-deposed panels 5 are stacked on one another by using the middle joint component 6 and the interlocking components 61 to form interconnection therebetween until the assembly of the rack assembly is completed. Each of the plurality of screws 62 is penetrated into the first opening 50 with a respective washer 63 to be locked in the first coupling portion 60. While locking the screw 62, each of middle joint components 6 gradually moves towards the direction of a tip end screw 62, which in turn presses backwardly a top side horizontally-deposed panel 5 located on the top side and then moves towards horizontally-deposed panels 5 located on the bottom layer by layer, as shown in FIG. 2B, thereby securely engaging vertically-deposed panel 7 with horizontally-deposed panels 5 interconnected by the interlocking components 61.

Each of vertically-deposed panels 7 is disposed between two horizontally-deposed panels 5, the buffering member 702 thereof contacts with the horizontally-deposed panels 5 and thus generates a friction force, which can maintain and hold the vertically-deposed panel 7 in position when being subjected to an external force or vibration.

As mentioned above, the height of the vertically-deposed panel 7 is greater than the length of the middle joint component 6, so that when a plurality of frame units are assembled together, the vertically-deposed panel 7 and horizontally-deposed panel 5 are not limited by the length of the middle joint component 6. Further, the middle joint component 6 is interconnected with the other the middle joint component 6 by means of the interlocking components 61 for interconnecting a pair of frame units, with one another to move relatively with the interlocking components 61, thereby securely fastening and engaging the vertically-deposed panel 7 with the horizontally-deposed panel 5 that are interconnected by the interlocking component 61. This feature allows the one or more frame units to be easily assembled at any position free of limitations of the length of the middle joint component 6 and the assembling location.

Moreover, the provision of the interconnected round apertures in the second opening 70 allows the middle joint component 6 to be arbitrarily disposed therein, such that the vertically-deposed panel 7 can be flexibly adjusted in linear manner with respect to the horizontally-deposed panel 5, thereby providing varieties in assembly for allowing the frame units to be freely assembled as desired.

Second Preferred Embodiment

Figure 3A:
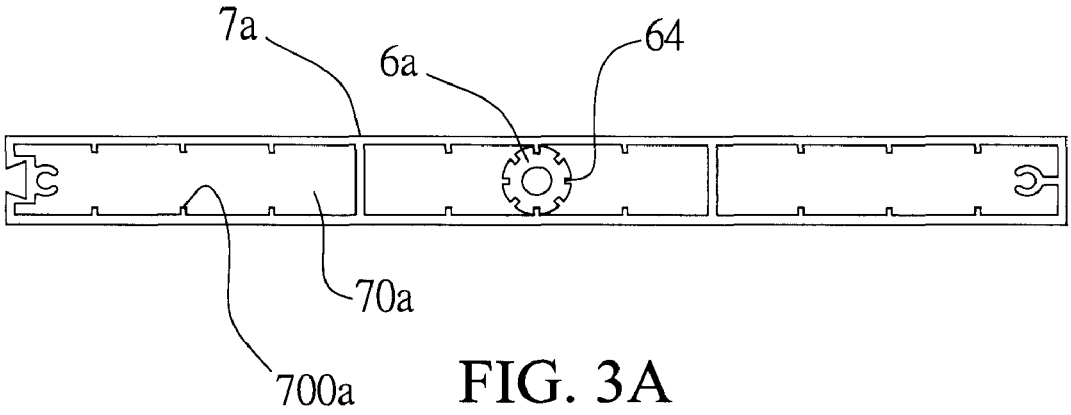
FIGS. 3A and 3B each are perspective views showing partial sections of a second embodiment of an interlocking component assembly of an expandable rack assembly according to the present invention.
Figure 3B:
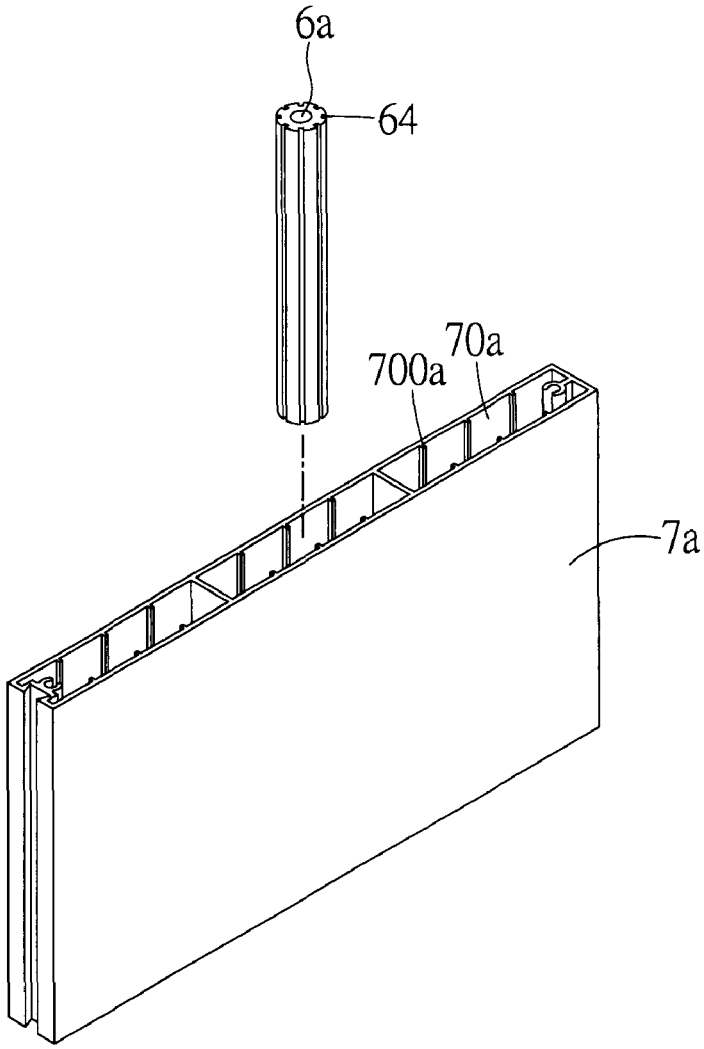

FIGS. 3A to 3B depict the second embodiment of the interlocking component assembly of an expandable rack assembly according to the present invention. In this illustrated embodiment, an alternative design of the vertically-deposed panel 7 and middle joint components 6 as is shown in FIGS. 2A and 2C respectively.

As shown in FIGS. 3A and 3B, the middle joint component 6*a* is a cylindrical body having a plurality of spaced out second positioning portions 64, which may be but are not limited to a groove, disposed on the peripheral wall thereof. Each vertically-deposed panel 7*a* is formed with a second opening 70*a* in which a plurality of spaced out first positioning portions 700*a*, which may be but is not limited to a protruding rib, are disposed on each of two opposed inner walls of the second opening 70*a* to form a plurality of interconnected rectangular apertures, wherein each of first positioning portions 700*a* is adapted to correspondingly couple with each of the second positioning portions 64, thereby positioning and fastening the middle joint component 6*a* in the second opening 70*a*.

Third Preferred Embodiment

Figure 4A:
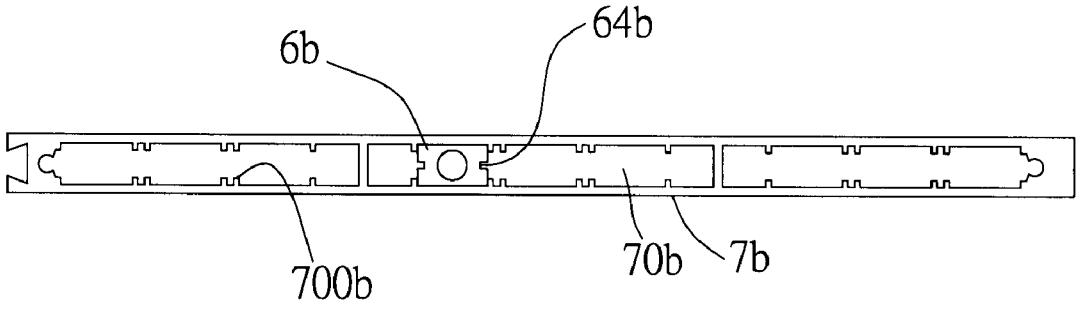
FIGS. 4A and 4B each are perspective views showing partial sections of a third embodiment of an interlocking component assembly of an expandable rack assembly according to the present invention.
Figure 4B:
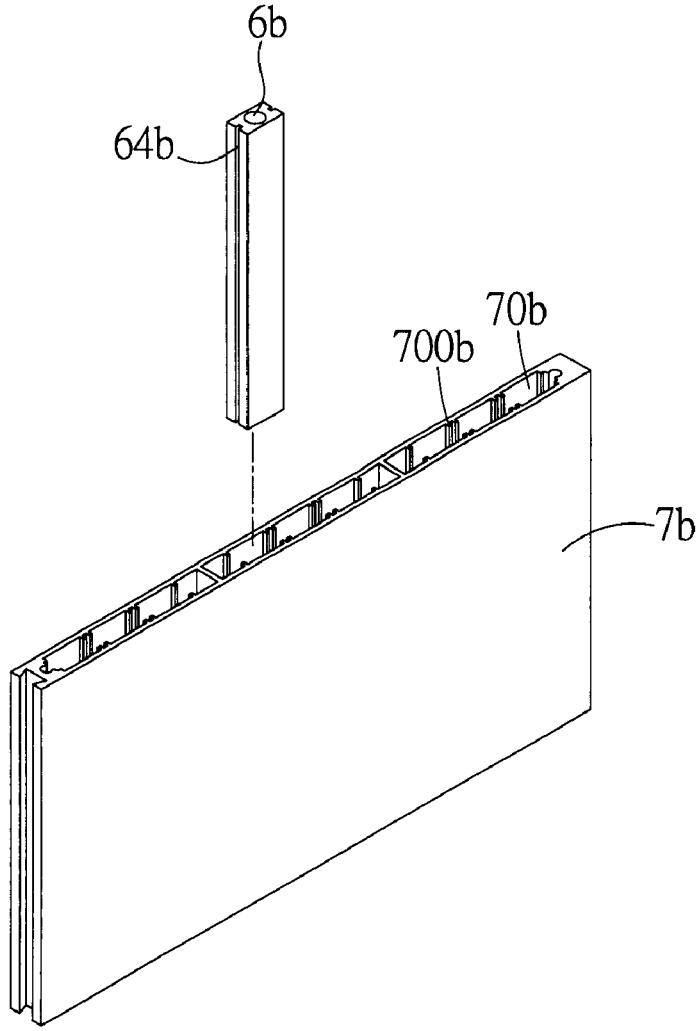

FIGS. 4A and 4B depict the third embodiment of the interlocking component assembly of an expandable rack assembly according to the present invention. In this illustrated embodiment, another alternative design of the vertically-deposed panel 7 and middle joint components 6 as is shown in FIGS. 2A and 2C respectively.

As shown in FIGS. 4A and 4B, the middle joint component 6*b* is a rectangular pillar in which a plurality of spaced out second positioning portions 64*b*, which may be but is not limited to a groove, are disposed on each of two opposed end portions thereof.

Each of the vertically-deposed panel 7*b* is formed with a second opening 70*b* in which a plurality of spaced out first positioning portions 700*b*, which may be but is not limited to a protruding rib, are on each of two opposed inner walls of the second opening 70*b* to form a plurality of interconnected rectangular apertures, wherein each of first positioning portions 700*b* is adapted to correspondingly couple with each of second positioning portions 64*b*, thereby positioning and fastening the middle joint component 6*b* in the interconnected rectangular aperture.

Fourth Preferred Embodiment

Figure 5A:
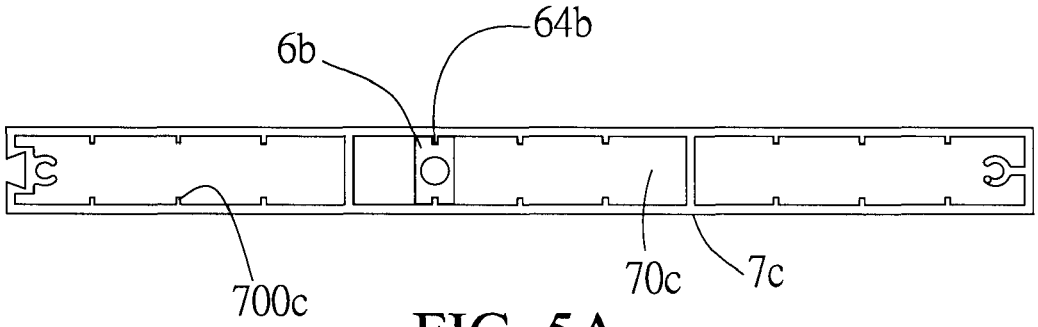
FIGS. 5A and 5B each are perspective views each showing partial sections of a fourth embodiment of an interlocking component assembly of an expandable rack assembly according to the present invention.
Figure 5B:
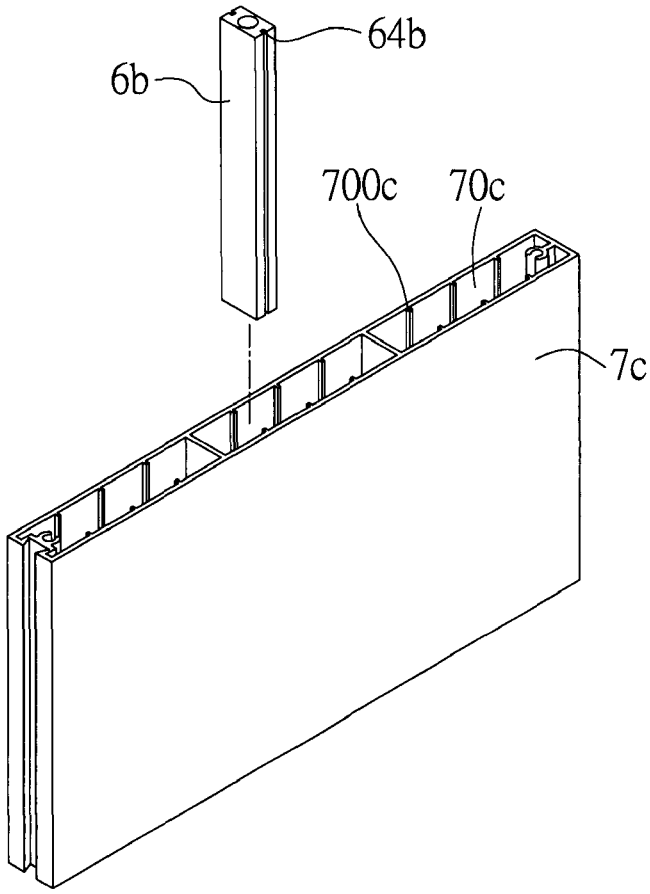

FIGS. 5A and 5B depict the fourth embodiment of the interlocking component assembly of an expandable rack assembly according to the present invention. In this illustrated embodiment, another alternative design of the vertically-deposed panel 7 is disclosed, and the design of middle joint components 6*b* has been disclosed in FIGS. 4A and 4B respectively.

Each of vertically-deposed panel 7*c* is formed with a second opening 70*c* in which a plurality of spaced out first positioning portions 700*c*, which may be but is not limited to a protruding rib, are disposed on each of two opposed inner walls of the second opening 70*c* to form a plurality of interconnected rectangular apertures, wherein each of first positioning portions 700*c* is adapted to correspondingly couple with each of second positioning portions 64*b*, thereby positioning and fastening the middle joint component 6*b* in the interconnected rectangular aperture.

Fifth Preferred Embodiment

Figure 6A:
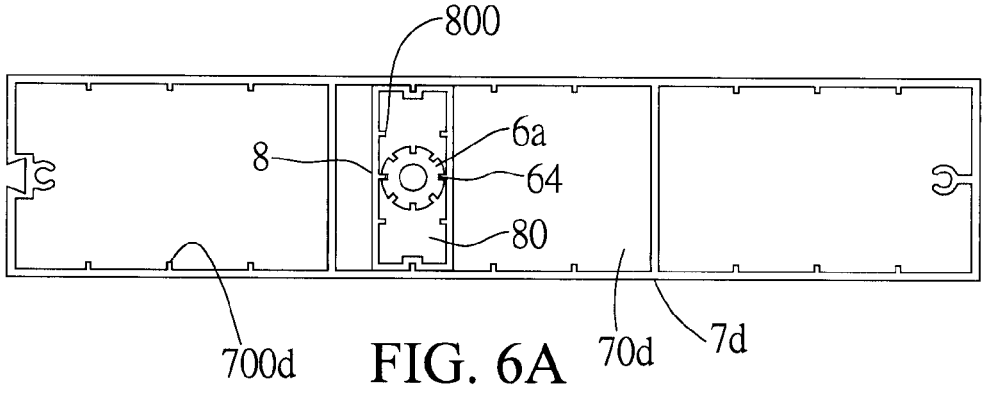
FIGS. 6A and 6B each are perspective views showing partial sections of a fifth embodiment of an interlocking component assembly of an expandable rack assembly according to the present invention.
Figure 6B:
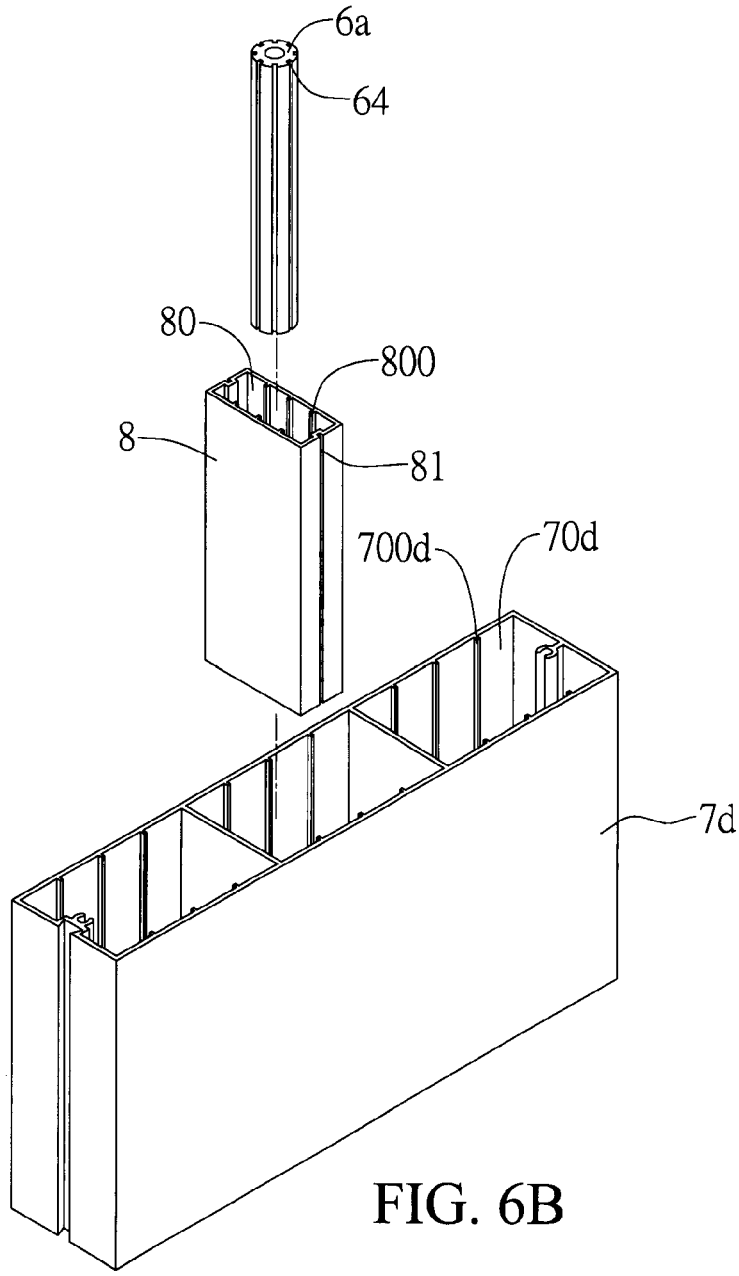

FIGS. 6A and 6B depict the fifth embodiment of the interlocking component assembly of an expandable rack assembly according to the present invention. In this illustrated embodiment, yet another alternative design of the vertically-deposed panel 7 is disclosed, and the design of middle joint components 6*a* has been disclosed in FIGS. 3A and 3B respectively.

Each of the vertically-deposed panel 7*d* is formed with a second opening 70*d* in which a plurality of spaced out first positioning portions 700*d*, which may be but is not limited to a protruding rib, are disposed on each of two opposed inner walls of the second opening 70*d* to form a plurality of interconnected rectangular apertures.

The illustrated embodiment further includes at least an assist vertically-deposed panel 8 which is a rectangular-shaped hollow body formed with a third opening 80 in which a plurality of spaced out third positioning portions 800, which may be but is not limited to a protruding rib, are disposed on each of two opposed inner walls of the third opening 80 to form a plurality of interconnected rectangular apertures, wherein a plurality of fourth positioning portion 81, which mat be but is not limited to a groove, are disposed on each of two opposed end portions of the assist vertically-deposed panel 8.

The assist vertically-deposed panels 8 is adapted to penetrate into a respective interconnected rectangular aperture formed in the second opening 70*d*. Each of fourth positioning portions 81 is coupled with a respectively first positioning portion 700*d* to position and fasten the assist vertically-deposed panel 8 in the second opening 70*d*. Each of middle joint components 6*a* is adapted to penetrate into the third opening 80, and is coupled with the second positioning portion 64 to thereby position and fasten the middle joint component 6*a* in the third positioning portions 800. Accordingly, the vertically-deposed panel 7*d* may be flexibly adjusted in a generally horizontal or vertical orientation with respect to the horizontally-deposed panel without being limited by the position of the first opening of the horizontally-deposed panel, thereby achieving an optimal position and application.

Summarizing the embodiments described above, the present invention is characterized in that the height of each of vertically-deposed panels 7, 7*a*, 7*c*, 7*d* is greater than the length of each of middle joint components 6, 6*a*, 6*b*, thereby enabling assembly of the frame unit to be free of limitations of the length of each of middle joint components 6, 6*a*, 6*b* as well as the installation location.

Further, the interaction between middle joint components 6, 6*a*, 6*b* enables each of vertically-deposed panels 7, 7*a*, 7*c*, 7*d* and each of horizontally-deposed panels 5 that are connected by interlocking components 61 to be tightly couple to one another and fastened in position while enhancing structural rigidity of the frame unit.

Moreover, the coordination of the horizontally-deposed panel with the vertically-deposed panel permits each of vertically-deposed panels 7, 7*a*, 7*c*, 7*d* to be flexibly adjusted in a generally horizontal or vertical orientation with respect to the horizontally-deposed panel 5 without being limited by the position of the first opening 50, thereby providing varieties in assembly for optimal effects and combinations of expandable rack assemblies.

Sixth Preferred Embodiment

Figure 7A:
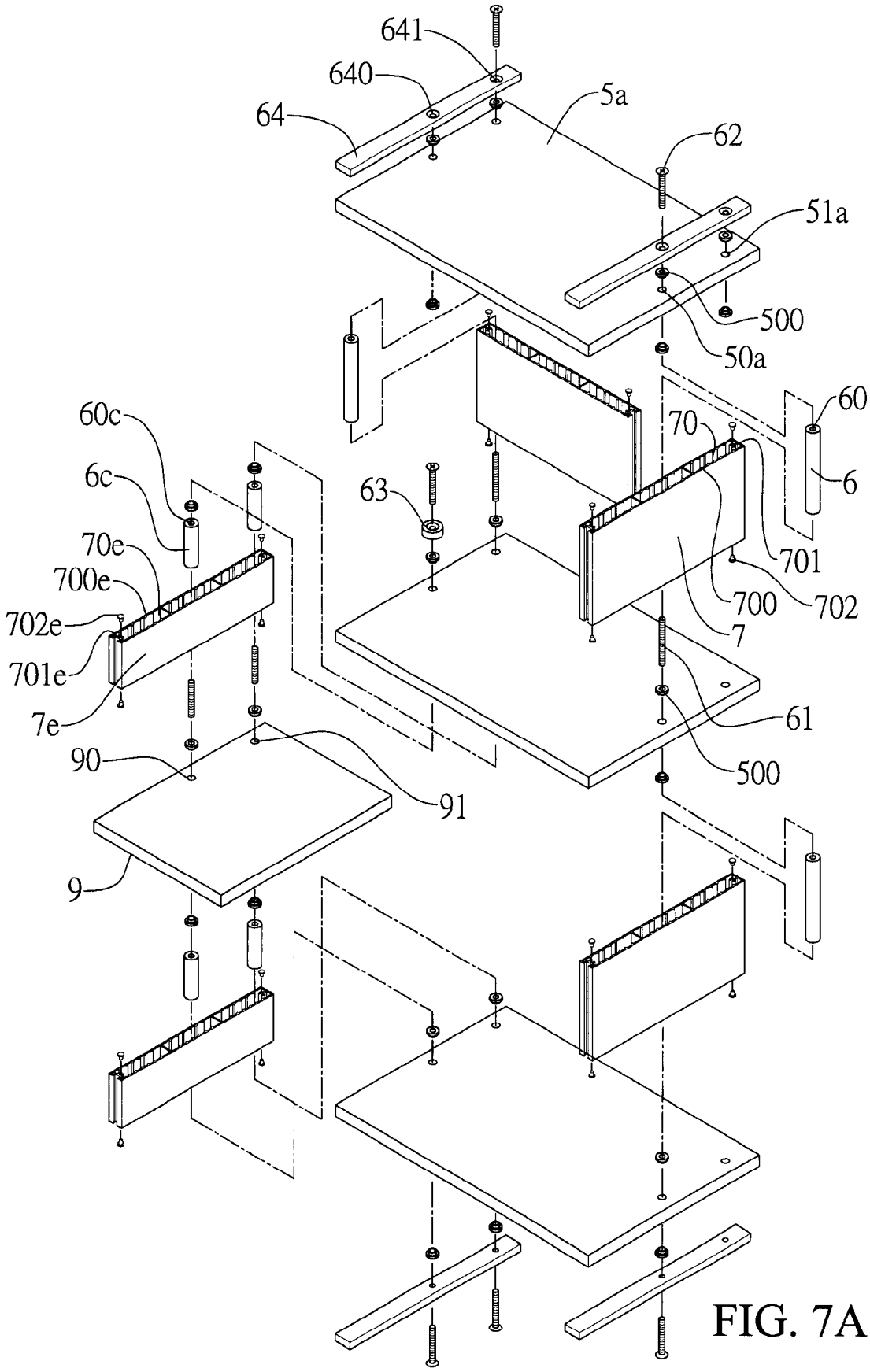
FIGS. 7A and 7C each are perspective views showing partial sections of a sixth embodiment of an interlocking component assembly of an expandable rack assembly according to the present invention.
Figure 7B:
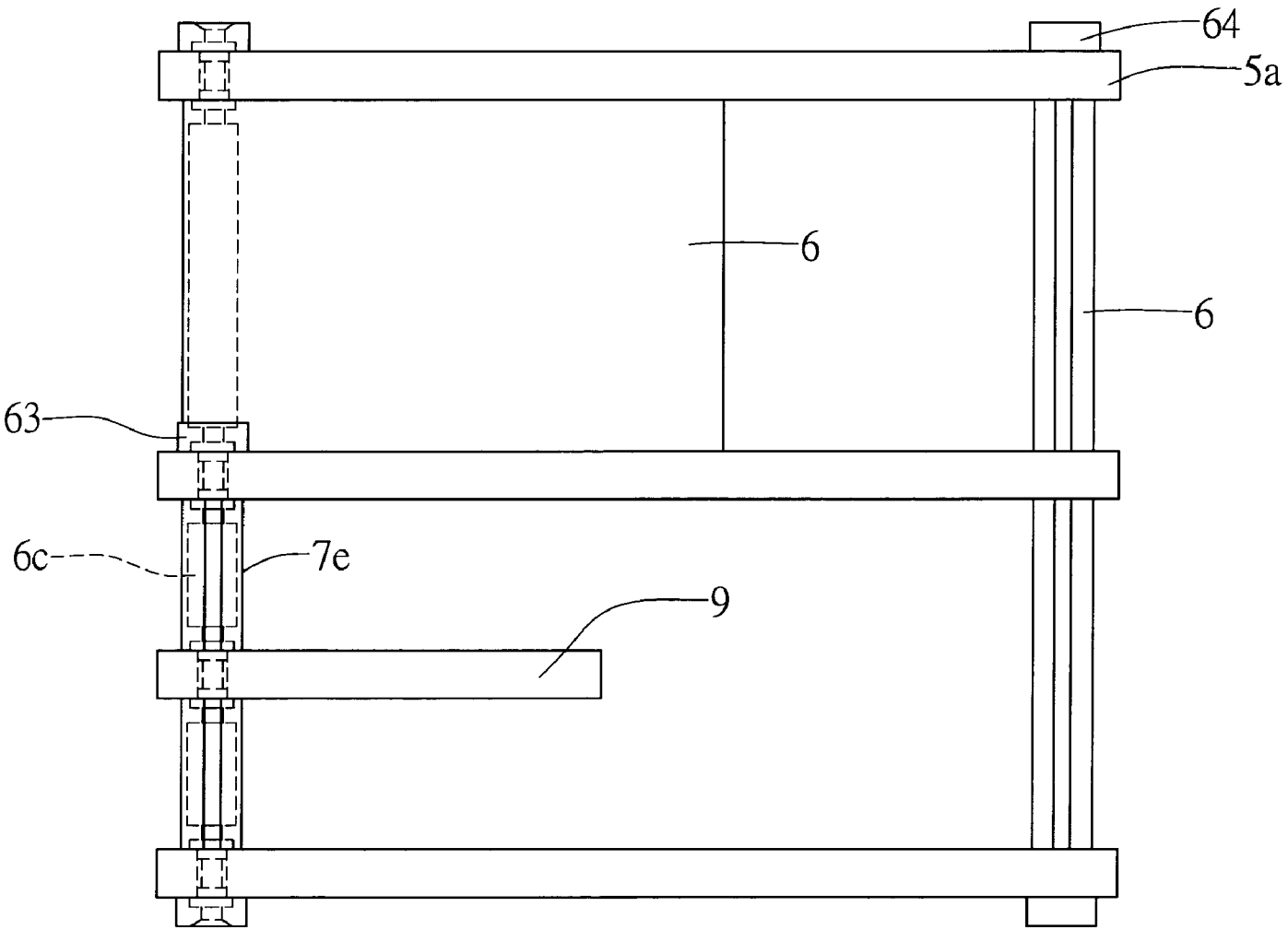
Figure 7C:
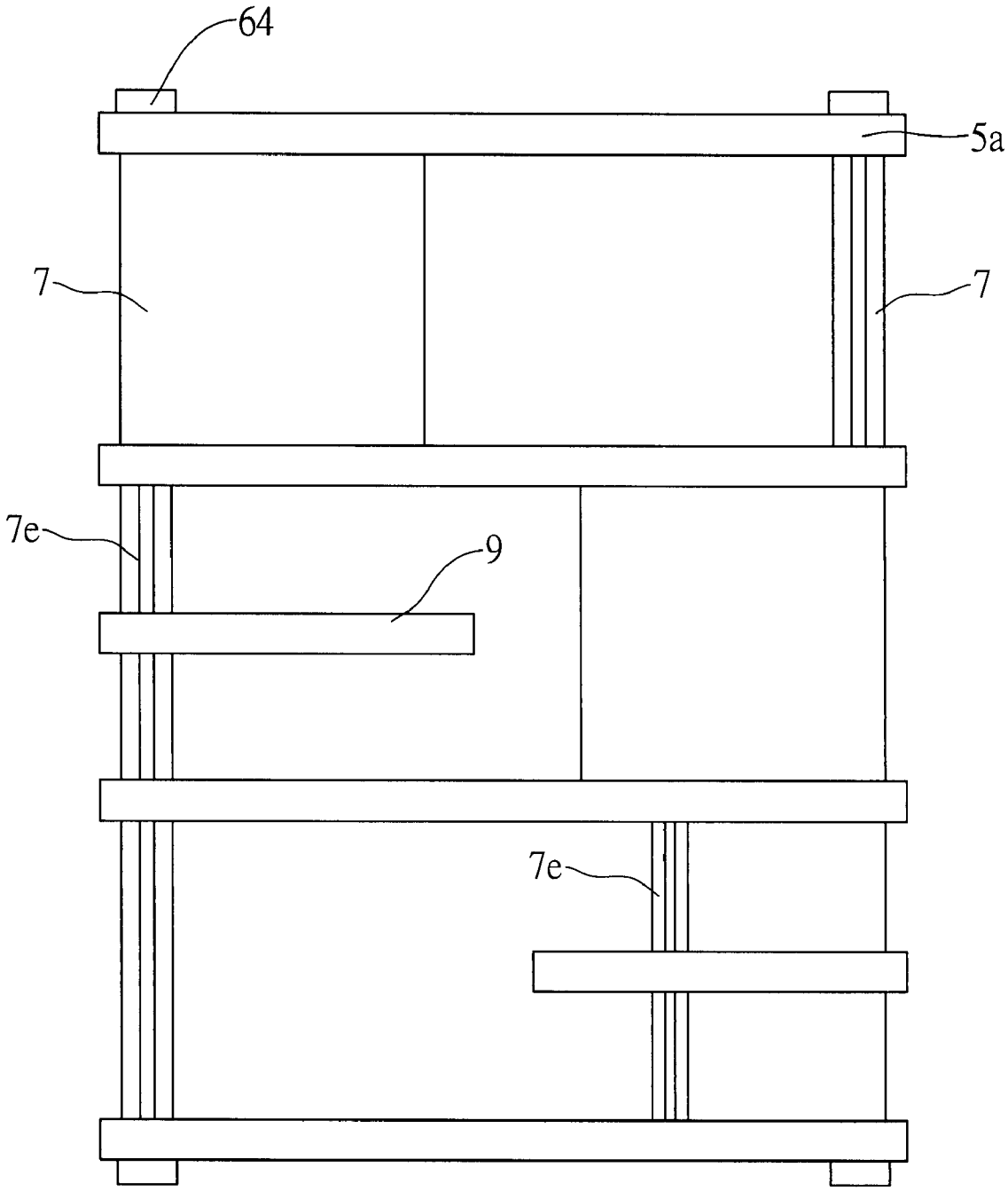

FIGS. 7A and 7C depict the sixth embodiment of the interlocking component assembly of an expandable rack assembly according to the present invention. In this illustrated embodiment, yet another alternative design of the interlocking component assembly of an expandable rack assembly is disclosed.

As shown in FIGS. 7A and 7B, the structural design of the vertically-deposed panel 7 and the middle joint components 6*a* in this embodiment is substantially the same as that disclosed in FIG. 2A and, therefore, it is not further described herein for brevity. Also, the structure is similar to each of vertically-deposed panels 7, 7*a*, 7*c*, 7*d* and each of middle joint components 6, 6*a*, 6*b* disclosed in FIGS. 3B, 4B, 5B, and 6B respectively.

Each of horizontally-deposed panels 5*a* is formed with a plurality of first openings 50*a* and a plurality of assist first openings 51*a*, each of first openings 50*a* being disposed at a central position on each of two opposed sides of the horizontally-deposed panel 5*a* respectively, and each of assist first openings 51*a* being disposed at an edge position on each of two opposed sides of the horizontally-deposed panel 5*a* respectively and is adjacent to the first opening 50*a*, wherein a protective sheath 500 is disposed to cover each of first openings 50*a* and assist first openings 51*a* respectively.

The present invention further includes a plurality of sub-vertically-deposed panels 7*e*, a plurality of sub-middle joint components 6*c* each disposed to penetrate into each of sub-vertically-deposed panels 7*e*, a sandwiched panel 9 disposed between the two sub-vertically-deposed panels 7*e*, and a plurality of pressing battens 64 each disposed on the horizontally-deposed panel 5*e*.

Similar to the vertically-deposed panel 7, the sub-vertically-deposed panel 7*e* is comprised of a second opening 70*e*, a first positioning portion 700*e*, an embedding portion 701*e*, and a buffering member 702*e*, wherein the sub-vertically-deposed panel 7*e* is shorter than the vertically-deposed panel 7 in height.

Similar to the middle joint component 6, the sub-middle joint component 6*c* comprises a first coupling portion 60*c* and is shorter than the middle joint component 6 in height.

The sandwiched panel 9 is formed with a through bore 90 and an assist through bore 91 at positions corresponding to the first opening 50*a* and the assist first opening 51*a* in the horizontally-deposed panel 5*a*, wherein a protective sheath 500 is respectively provided to cover both the through bore 90 and the assist through bore 91.

Each of pressing battens 64 is formed with a through bore 640 and an assist through bore 641 at positions corresponding to the first opening 50*a* and the assist first opening 51*a* in the horizontally-deposed panel 5*a*.

In assembly, the vertically-deposed panel 7 may be deposed on one side of the horizontally-deposed panel 5*a*, and a vertically deposed panel 7, a sub-vertically-deposed panel 7*e* and a sandwiched panel 9 may be disposed on the other opposed side thereof. The method of assembling the vertically-deposed panel 7 on one side of the horizontally-deposed panel 5*a* is substantially the same as that disclosed in the first embodiment, therefore, it is not further described herein for brevity. The only difference between this and the first embodiment is that a screw 62 is fastened into the through bore 640 in the pressing batten 64 and the first opening 50*a* and is locked in the first coupling portion 60. The one side of the horizontally-deposed panel 5*a*, on which the vertically-deposed panel 7, the sub-vertically-deposed panel 7*e* and the sandwiched panel 9 are assembled, is fastened by a pair of screws 62 by locking into the through bore 640 and the assist through bore 641 formed in the pressing batten 64 respectively, and is locked in a first coupling portion 60*c* formed on each of the two sub-middle joint components 6*c*, while the other first coupling portion 60*c* thereof is locked to an interlocking component 61, the two interlocking components each penetrating into in. The through bore 90 and the assist through bore 91 of the sandwiched panel 9 respectively, and further are locked in both the second opening 70*e* of the sub-vertically-deposed panel 7*e* and the first coupling portion 60*c* of the sub-middle joint component 6*c*.

A screw 62 is adapted to penetrate through a corresponding washer 63 and the first opening 50*a* of the horizontally-deposed panel 5*a* respectively, and is locked in the other first coupling portion 60*c* of the sub-middle joint component 6*c*. An interlocking component 61 is locked to the other first coupling portion 60*c* of the other sub-middle joint component 6*c*, and is locked to a first coupling portion 60 of a middle joint component 6 located at an outmost side with respect to the first opening 70 of the vertically-deposed panel 7, one end of the vertically-deposed panel 7 extending towards the other vertically-deposed panel 7 disposed on the other side of the horizontally-deposed panel 5, the other screw 62 penetrating into the assist through bore 641 of the pressing batten 64 and the assist first opening 51*a* respectively, and being locked to the other first coupling portion 60 of the middle joint component 6.

As shown in FIG. 7, the foregoing embodiment includes at least one layer structure wherein one side of the horizontally-deposed panel 5*a* has at least two vertically-deposed panels 7, a sub-vertically-deposed panel 7*e* and a sandwiched panel 9 mounted orderly thereon, while the other side thereof has two vertically-deposed panels 7, a sub-vertically-deposed panel 7*e* and a sandwiched panel 9 mounted orderly thereon. According to the practical situation, a screw 62 may be optionally added to be locked in the first opening 50*a* or the assist first opening 51*a*, such that only one sub-middle joint component is required in the sub-vertically-deposed panel 7*e* to enable deflective rotation at all angles as desired, and the vertically-deposed panel 7 can also be deflective rotated at all angles, as shown in FIGS. 7B and 7C, since there in only one middle joint component 6 disposed therein.

In the foregoing structure, the vertically-deposed panel 7 having one end thereof extending from the other vertically-deposed panel 7 may function as a rear wall structure, the sandwiched panel 9 may be used to store things, and the two horizontally-deposed panels may be divided into a plurality of spaces for storage purposes as well.

While the illustrative embodiments are provided in the above description, such is for illustration of principles and functions of the present invention only and it is not to be construed restrictively. Modifications and variations of the present invention that will be obvious to those skilled in the art in the art are to be covered by the following claims.

The invention claimed is:

1. An interlocking component assembly of an expandable rack assembly, said interlocking component assembly comprising:

a plurality of horizontally-deposed panels each formed with a first opening;

a plurality of vertically-deposed panels each disposed between two horizontally-deposed panels and formed with a second opening flush with the first opening, wherein a first positioning portion is disposed on each of two opposed inner walls of the second opening respectively, a plurality of middle joint components adapted to penetrate through the second opening of each vertically-deposed panel and being fastened by the first positioning portions, wherein a first coupling portion is disposed at each of two ends of the middle joint components thereof, and the middle joint component has a length smaller than the height of the vertically-deposed panel; and a plurality of interlocking components adapted to penetrate through the first opening of the horizontally-deposed panel, and having a second coupling portion corresponding to the first coupling portion disposed at each of the two ends thereof for coupling a pair of middle joint components together and thus interconnecting the horizontally-deposed panel with the vertically-deposed panel.

2. The interlocking component assembly of an expandable rack assembly according to claim 1, wherein the horizontally-deposed panel is a panel body made of a material selected from the group consisting of glass, stone, cement, metal and wood.

3. The interlocking component assembly of an expandable rack assembly according to claim 1, wherein a buffering member is disposed on each of two opposed ends of the vertically-deposed panel at a position in contact with the horizontally-deposed panel, and wherein an embedding portion for holding the buffering member is disposed at each of the two opposed ends of the vertically-deposed panel at a position close to the second opening.

4. The interlocking component assembly of an expandable rack assembly according to claim 1, wherein the second opening comprises a plurality of interconnected round apertures, and the middle joint component is a cylindrical body positioned in a corresponding one of the round apertures, the outer diameter of the middle joint component being larger than that of the first opening.

5. The interlocking component assembly of an expandable rack assembly according to claim 1, wherein the second opening comprises a plurality of interconnected rectangular apertures, and the middle joint component is a rectangular pillar to be positioned in a corresponding one of the rectangular apertures.

6. The interlocking component assembly of an expandable rack assembly according to claim 1, wherein the first positioning portion of the vertically-deposed panel comprises protruding ribs, and wherein a second positioning portion comprising grooves is disposed on the outer peripheral wall of the middle joint component for correspondingly coupling with the protruding ribs of the first positioning portion.

7. The interlocking component assembly of an expandable rack assembly according to claim 1, wherein the first coupling portion comprises screw bores and the second coupling portion comprises screws.

8. The interlocking component assembly of an expandable rack assembly according to claim 1, wherein an assist vertically-deposed panel is disposed in the second opening for allowing the middle joint components to penetrate therethrough, the assist vertically-deposed panel being formed with a third opening for receiving the middle joint component therein; wherein a fourth positioning portion which comprises grooves is disposed on each of the two opposed ends of the assist vertically-deposed panel for coupling with the first positioning portion which comprises protruding ribs; wherein a third positioning portion which comprises protruding ribs is disposed on each of the two opposed inner walls of the third opening; and wherein a second positioning portion which comprises grooves is disposed on the outer peripheral wall of the middle joint component for coupling with the protruding ribs of the third positioning portion.

9. The interlocking component assembly of an expandable rack assembly according to claim 1, wherein a protective sheath is adapted to cover the first opening.

* * * * *